US009418604B2

(12) United States Patent
Kim et al.

(10) Patent No.: US 9,418,604 B2
(45) Date of Patent: Aug. 16, 2016

(54) METHOD OF COMPENSATIING A LEFT-RIGHT GAMMA DIFFERENCE, VISION INSPECTION APPARATUS PERFORMING THE METHOD AND DISPLAY APPARATUS UTILIZING THE METHOD

(71) Applicant: Samsung Display Co., LTD., Yongin, Gyeonggi-Do (KR)

(72) Inventors: Se-Yun Kim, Daegu (KR); Hoi-Sik Moon, Ansan-si (KR)

(73) Assignee: SAMSUNG DISPLAY CO., LTD. (KR)

( * ) Notice: Subject to any disclaimer, the term of this patent is extended or adjusted under 35 U.S.C. 154(b) by 96 days.

(21) Appl. No.: 14/222,897

(22) Filed: Mar. 24, 2014

(65) Prior Publication Data

US 2015/0145894 A1 May 28, 2015

(30) Foreign Application Priority Data

Nov. 22, 2013 (KR) ..... 10-2013-0143293

(51) Int. Cl.
*G09G 3/36* (2006.01)

(52) U.S. Cl.
CPC ..... *G09G 3/3607* (2013.01); *G09G 2320/0233* (2013.01); *G09G 2320/0673* (2013.01); *G09G 2320/0693* (2013.01); *G09G 2360/145* (2013.01)

(58) Field of Classification Search
CPC ..... G09G 3/3607; G09G 2310/027; G09G 2320/0233; G09G 2320/0693
USPC ..... 345/690, 87–89, 204, 589
See application file for complete search history.

(56) References Cited

U.S. PATENT DOCUMENTS

| | | | | |
|---|---|---|---|---|
| 7,170,535 | B2 | 1/2007 | Matsuda | |
| 8,107,123 | B2 | 1/2012 | Ono et al. | |
| 2002/0097439 | A1 * | 7/2002 | Braica | G06K 15/1209 358/3.26 |
| 2006/0103683 | A1 | 5/2006 | Kang | |
| 2010/0128053 | A1 * | 5/2010 | Kato | G09G 5/06 345/589 |

FOREIGN PATENT DOCUMENTS

| | | | |
|---|---|---|---|
| JP | 2001134252 | A | 5/2001 |
| JP | 2011034044 | A | 2/2011 |
| KR | 1020130051751 | A | 5/2013 |

OTHER PUBLICATIONS

Search Report Application No. LL-201309-322-1 dated Oct. 13, 2013.

* cited by examiner

*Primary Examiner* — Jennifer Nguyen
(74) *Attorney, Agent, or Firm* — Cantor Colburn LLP

(57) ABSTRACT

A method of compensating a left-right gamma difference in a display apparatus using a vision inspection apparatus, which includes sensing sample grayscales displayed on areas defined on a display area of the display apparatus using image sensors of the vision inspection apparatus, estimating intensity values of a left reference boundary at a central area, a left boundary area, a right reference boundary area at the central area and a right boundary area, calculating a first grayscale correction value of the left boundary area such that an intensity estimation value of the left boundary area is substantially equal to an intensity estimation value of the left reference boundary area, and calculating a second grayscale correction value of the right boundary area such that an intensity estimation value of the right boundary area is substantially equal to an intensity estimation value of the right reference boundary area.

20 Claims, 6 Drawing Sheets

METHOD OF COMPENSATIING A LEFT-RIGHT GAMMA DIFFERENCE, VISION INSPECTION APPARATUS PERFORMING THE METHOD AND DISPLAY APPARATUS UTILIZING THE METHOD

This application claims priority to Korean Patent Application No. 10-2013-0143293 filed on Nov. 22, 2013, and all the benefits accruing therefrom under 35 U.S.C. §119, the contents of which in its entirety is herein incorporated by reference.

BACKGROUND

1. Field

Exemplary embodiments of the invention relate to a method of compensating a left-right gamma difference, a vision inspection apparatus performing the method and a display apparatus utilizing the method. More particularly, exemplary embodiments of the invention relate to a method of compensating a left-right gamma difference of a display apparatus, a vision inspection apparatus performing the method and a display apparatus utilizing the method.

2. Description of the Related Art

In general, a liquid crystal ("LC") display panel includes a lower substrate, an upper substrate opposite to the lower substrate and an LC layer disposed between the lower substrate and the lower substrate. The lower substrate includes a pixel area for defining a pixel and a peripheral area for receiving a driving signal which is applied to the pixel.

In such an e LC display panel, a data line, a gate line and a pixel electrode may be disposed in the pixel area. The data line may extend in a first direction, the gate line may extend in a second direction crossing the first direction, and the pixel electrode may be connected to the data line and the gate line. A first driving chip pad and a second driving chip pad may be disposed in the peripheral area. The first driving chip pad may receive a data signal, and the second driving chip pad may receive a gate signal.

After the LC layer is disposed between the lower substrate and the lower substrate, the LC panel is tested through a visual test process which tests electrical and optical operations of the LC panel. In general, the visual test process tests include testing various pattern stains by using a tester's eyes and removing the various pattern stains using a stain remover algorithm based on a tested result using the tester's eyes.

SUMMARY

As described above, the various pattern stains are typically manually tested by the tester, such that a test process period is increased and identification differences of the testers may occur. Thus, productivity may be decreased and compensation error may be increased when the pattern stains are manually tested by the tester.

Exemplary embodiments of the invention provide a method of compensating a left-right gamma difference for a uniform intensity of the display apparatus.

Exemplary embodiments of the invention provide a vision inspection apparatus performing the method.

Exemplary embodiments of the invention provide a display apparatus utilizing the method.

According to an exemplary embodiment of the invention, a method of compensating a left-right gamma difference in a display apparatus using a vision inspection apparatus, includes sensing a plurality of sample grayscales displayed on a plurality of areas defined on a display area of the display apparatus using a plurality of image sensors of the vision inspection apparatus, estimating intensity values of a left reference boundary area which is adjacent to a left side at a central area of the display area, a left boundary area which is adjacent to a left end portion of the display area, a right reference boundary area which is adjacent to a right side at the central area, and a right boundary area which is adjacent to a right end portion of the display area, calculating a first grayscale correction value of the left boundary area such that an intensity estimation value of the left boundary area is substantially equal to an intensity estimation value of the left reference boundary area, and calculating a second grayscale correction value of the right boundary area such that an intensity estimation value of the right boundary area is substantially equal to an intensity estimation value of the right reference boundary area.

In an exemplary embodiment, a plurality of left grayscale correction values, which is gradually increased from the central area to the left end portion of the display area, may be calculated based on the first grayscale correction value of the left boundary area, and a plurality of right grayscale correction values, which is gradually increased from the central area to the right end portion of the display area, may be calculated based on the second grayscale correction value of the right boundary area.

In an exemplary embodiment, the method may further include storing the plurality of left grayscale correction values corresponding to the plurality of sample grayscales, respectively, and the plurality of right grayscale correction values corresponding to the plurality of sample grayscales, respectively.

In an exemplary embodiment, the method may further include calculating a plurality of average intensity values of first and second left intensity areas, which are located opposite to each other in a vertical direction from the left boundary area, a plurality of average intensity values of first and second left reference intensity areas, which are located opposite to each other in the vertical direction from the left reference boundary area, a plurality of average intensity values of first and second right intensity areas, which are located opposite to each other in the vertical direction from the right boundary area, a plurality of average intensity values of first and second right reference intensity areas, which are located opposite to each other in the vertical direction from the right reference boundary area, utilizing sensed data received from the plurality of image sensors.

In an exemplary embodiment, the intensity estimation value of the left reference boundary area may be calculated utilizing the average intensity values of the first and second left reference intensity areas, the intensity estimation value of the left boundary area may be calculated utilizing the average intensity values of the first and second left intensity areas, the intensity estimation value of the right reference boundary area may be calculated utilizing the average intensity values of the first and second right reference intensity areas, and the intensity estimation value of the right boundary area may be calculated utilizing the average intensity values of the first and second right intensity areas.

In an exemplary embodiment, the sensed data of the first left intensity area and the first left reference intensity area may be sensed by a first image sensor of the plurality of image sensors, the sensed data of the first right intensity area and the first right reference intensity area may be sensed by a second image sensor of the plurality of image sensors, the sensed data of the second left intensity area and the second left reference intensity area may be sensed by a third image sensor of the plurality of image sensors, and the sensed data of the second right intensity area and the second right reference intensity area may be sensed by a fourth image sensor of the plurality of image sensors.

In an exemplary embodiment, each of the first left intensity area, the first left reference intensity area, the first right intensity area, the first right reference intensity area, the second left intensity area, the second left reference intensity area, the second right intensity area and the second right reference intensity area may be defined by a plurality of pixels of the display apparatus.

In an exemplary embodiment, the method may further include calculating a left gamma curve utilizing a plurality of intensity estimation values of the left boundary area corresponding to the plurality of sample grayscales, respectively, and calculating a right gamma curve utilizing a plurality of intensity estimation values of the right boundary area corresponding to the plurality of sample grayscales, respectively.

In an exemplary embodiment, the first grayscale correction value of the left boundary area may be calculated utilizing the left gamma curve, and the second grayscale correction value of the right boundary area is calculated utilizing the right gamma curve.

According to an exemplary embodiment of the invention, a vision inspection apparatus includes a plurality of image sensors configured to sense a plurality of sample grayscales displayed on a plurality of areas defined in a display area of a display apparatus, a left-right intensity estimator configured to calculate intensity estimation values of a left reference boundary area which is adjacent to a left side at a central area of the display area, a left boundary area which is adjacent to a left end portion of the display area, a right reference boundary area which is adjacent to a right side at the central area, and a right boundary area which is adjacent to a right end portion of the display area, and a correction value calculator configured to calculate a first grayscale correction value of the left boundary area such that an intensity estimation value of the left boundary area is substantially equal to an intensity estimation value of the left reference boundary area and a second grayscale correction value of the right boundary area such that an intensity estimation value of the right boundary area is substantially equal to an intensity estimation value of the right reference boundary area.

In an exemplary embodiment, the correction value calculator may be configured to calculate a plurality of left grayscale correction values, which is gradually increased from the central area to the left end portion of the display area, based on the first grayscale correction value of the left boundary area, and a plurality of right grayscale correction values, which is gradually increased from the central area to the right end portion of the display area, based on the second grayscale correction value of the right boundary area.

In an exemplary embodiment, the vision inspection apparatus may further include a memory configured to store the plurality of left grayscale correction values corresponding to the plurality of sample grayscales, respectively, and the plurality of right grayscale correction values corresponding to the plurality of sample grayscales, respectively.

In an exemplary embodiment, the vision inspection apparatus may further include an average intensity calculator configured to calculate a plurality of average intensity values of first and second left intensity areas which are located opposite to each other in a vertical direction from the left boundary area, a plurality of average intensity values first and second left reference intensity areas which are located opposite to each other in the vertical direction from the left reference boundary area, a plurality of average intensity values first and second right intensity areas which are located opposite to each other in the vertical direction from the right boundary area, and a plurality of average intensity values first and second right reference intensity areas which are located opposite to each other in the vertical direction from the right reference boundary area, utilizing sensed data received from the plurality of image sensors.

In an exemplary embodiment, the average intensity calculator may be configured to calculate the intensity estimation value of the left reference boundary area utilizing the average intensity values of the first and second left reference intensity areas, the intensity estimation value of the left boundary area utilizing the average intensity values of the first and second left intensity areas, the intensity estimation value of the right reference boundary area utilizing the average intensity values of the first and second right reference intensity areas, and the intensity estimation value of the right boundary area utilizing the average intensity values of the first and second right intensity areas.

In an exemplary embodiment, the plurality of image sensors may include a first image sensor configured to sense the plurality of sample grayscales displayed on the first left intensity area and the first left reference intensity area, a second image sensor configured to sense the plurality of sample grayscales displayed on the first right intensity area and the first right reference intensity area, a third image sensor configured to sense the plurality of sample grayscales displayed on the second left intensity area and the second left reference intensity area are sensed by, and a fourth image sensor configured to sense the plurality of sample grayscales on displayed on the second right intensity area and the second right reference intensity.

In an exemplary embodiment, each of the first left intensity area, the first left reference intensity area, the first right intensity area, the first right reference intensity area, the second left intensity area, the second left reference intensity area, the second right intensity area and the second right reference intensity area may be defined by a plurality of pixels, and the average intensity calculator may be configured to calculate an average intensity value of the plurality of pixels.

In an exemplary embodiment, the vision inspection apparatus may further include a gamma curve calculator configured to calculate a left gamma curve utilizing a plurality of intensity estimation values of the left boundary area corresponding to the plurality of sample grayscales, respectively, and a right gamma curve utilizing a plurality of intensity estimation values of the right boundary area corresponding to the plurality of sample grayscales, respectively.

In an exemplary embodiment, the correction value calculator may be configured to calculate the first grayscale correction value of the left boundary area utilizing the left gamma curve, and the second grayscale correction value of the right boundary area utilizing the right gamma curve.

According to an exemplary embodiment of the invention, there is provided a display apparatus. The display apparatus includes a display panel comprising a plurality of pixels which is disposed in a display area, a memory storing a first grayscale correction value of a left boundary area and a second grayscale correction value of a right boundary area to compensate a gamma difference between the left boundary area and the right boundary area, where the left boundary area is located adjacent to a left end portion of the display area, and the right boundary area is located adjacent to a right end portion of the display area, a data corrector configured to generate correction grayscale data to correct grayscale data of a pixel based on the first and second grayscale correction values and a data driver configured to generate a grayscale voltage based on the correction grayscale data and to provide a data line of the display panel with the grayscale voltage.

In an exemplary embodiment, the memory may be configured to store a plurality of left grayscale correction values corresponding to the plurality of sample grayscales, respectively, and a plurality of right grayscale correction values corresponding to the plurality of sample grayscales, respectively, where the plurality of left grayscale correction values are gradually increased from the central area to the left end portion of the display area based on the first grayscale correction value of the left boundary area, and the plurality of right grayscale correction values are gradually increased from the central area to the right end portion of the display area based on the second grayscale correction value of the right boundary area.

According to exemplary embodiments of the invention, a left-right gamma difference of the display panel may be effectively compensated such that left-right intensity may be substantially uniform. In such embodiments, the intensity may be gradually compensated from the central area toward a left side and a right side such that the display quality may be improved.

BRIEF DESCRIPTION OF THE DRAWINGS

The above and other features of the invention will become more apparent by describing in detailed exemplary embodiments thereof with reference to the accompanying drawings, in which.

DETAILED DESCRIPTION

Figure 1:
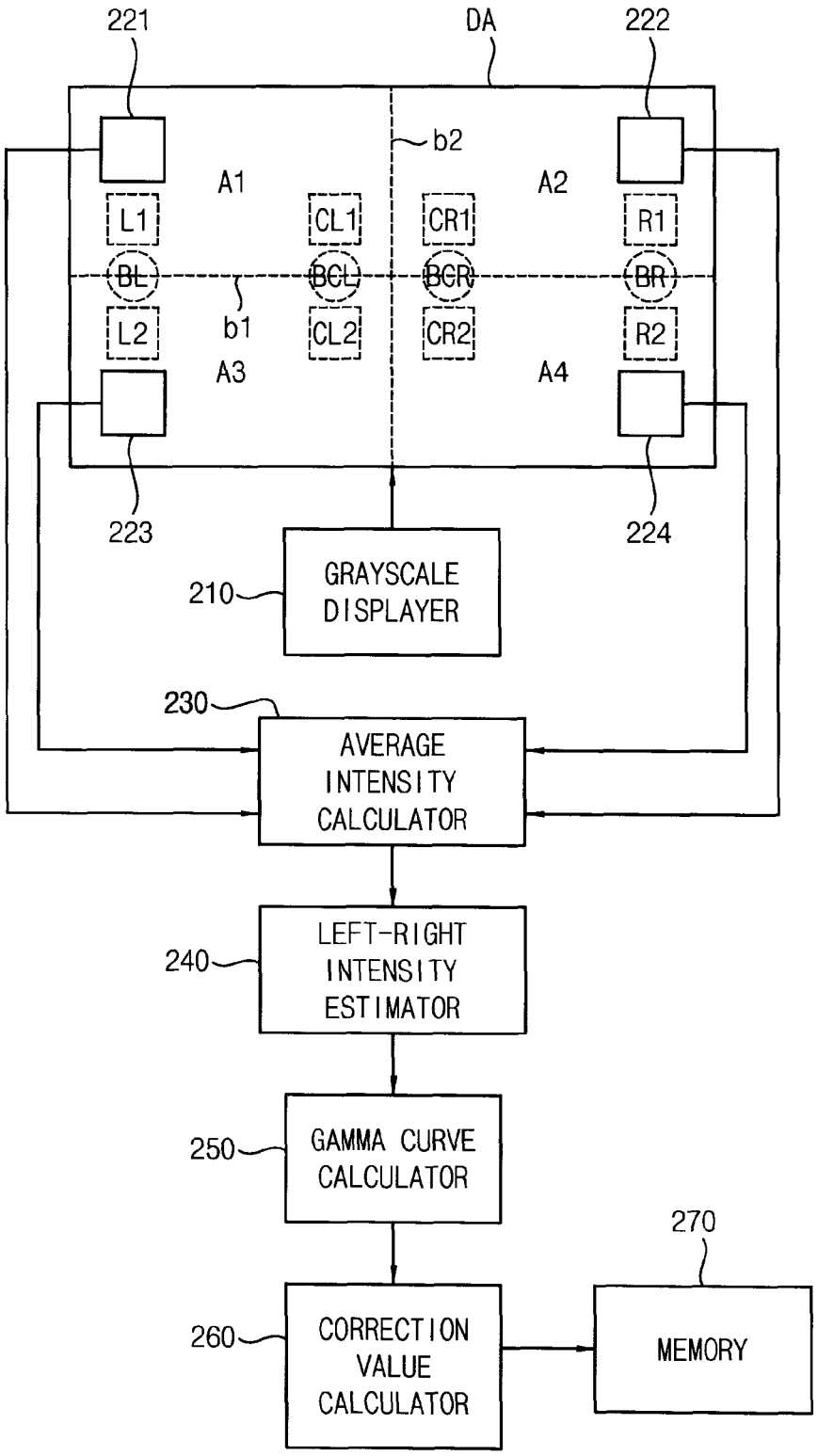
FIG. 1 is a block diagram illustrating an exemplary embodiment of a vision inspection apparatus, according to the invention.

The invention now will be described more fully hereinafter with reference to the accompanying drawings, in which various embodiments are shown. This invention may, however, be embodied in many different forms, and should not be construed as limited to the embodiments set forth herein. Rather, these embodiments are provided so that this disclosure will be thorough and complete, and will fully convey the scope of the invention to those skilled in the art. Like reference numerals refer to like elements throughout.

It will be understood that when an element is referred to as being "on" another element, it can be directly on the other element or intervening elements may be therebetween. In contrast, when an element is referred to as being "directly on" another element, there are no intervening elements present.

It will be understood that, although the terms "first," "second," "third" etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, "a first element," "component," "region," "layer" or "section" discussed below could be termed a second element, component, region, layer or section without departing from the teachings herein.

The terminology used herein is for the purpose of describing particular embodiments only and is not intended to be limiting. As used herein, the singular forms "a," "an," and "the" are intended to include the plural forms, including "at least one," unless the content clearly indicates otherwise. "Or" means "and/or." As used herein, the term "and/or" includes any and all combinations of one or more of the associated listed items. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower," can therefore, encompasses both an orientation of "lower" and "upper," depending on the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

"About" or "approximately" as used herein is inclusive of the stated value and means within an acceptable range of deviation for the particular value as determined by one of ordinary skill in the art, considering the measurement in question and the error associated with measurement of the particular quantity (i.e., the limitations of the measurement system). For example, "about" can mean within one or more standard deviations, or within ±30%, 20%, 10%, 5% of the stated value.

Unless otherwise defined, all terms (including technical and scientific terms) used herein have the same meaning as commonly understood by one of ordinary skill in the art to which this disclosure belongs. It will be further understood that terms, such as those defined in commonly used dictionaries, should be interpreted as having a meaning that is consistent with their meaning in the context of the relevant art and the disclosure, and will not be interpreted in an idealized or overly formal sense unless expressly so defined herein.

Exemplary embodiments are described herein with reference to cross section illustrations that are schematic illustrations of idealized embodiments. As such, variations from the shapes of the illustrations as a result, for example, of manufacturing techniques and/or tolerances, are to be expected. Thus, embodiments described herein should not be construed as limited to the particular shapes of regions as illustrated herein but are to include deviations in shapes that result, for example, from manufacturing. For example, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the claims.

Hereinafter, exemplary embodiments of the invention will be described in detail with reference to the accompanying drawings.

FIG. 1 is a block diagram illustrating an exemplary embodiment of a vision inspection apparatus, according to the invention.

Referring to FIG. 1, an exemplary embodiment of the vision inspection apparatus may include a grayscale displayer 210, a plurality of image sensors 221, 222, 223 and 224, an average intensity calculator 230, a left-right intensity estimator 240, a gamma curve calculator 250, a correction value calculator 260 and a memory 270.

The grayscale displayer 210 displays a plurality of sample grayscales on the display area DA of the display apparatus. In one exemplary embodiment, for example, the grayscale displayer 210 generates image signals to the display apparatus to display the sample grayscales. In an exemplary embodiment, the sample grayscales may include O-grayscale, 16-grayscale, 24-grayscale, 32-grayscale, 64-grayscale, 96-grayscale, 128-grayscale, 192-grayscale and 255-grayscale with respect to 256 of total grayscale number, but not being limited thereto. In an alternative exemplary embodiment, the sample grayscales may be preset variously.

The plurality of image sensors 221, 222, 223 and 224 is configured to sense the sample grayscales displayed on the display area DA of the display apparatus. Each of the image sensors 221, 222, 223 and 224 may include a charge-coupled ("CCD") camera and a complementary metal-oxide-semiconductor ("CMOS") camera, for example.

The plurality of image sensors 221, 222, 223 and 224 includes a first image sensor 221, a second image sensor 222, a third image sensor 223 and a fourth image sensor 224. The first image sensor 221 is configured to sense the sample grayscales displayed on a first area A1 of the display area DA. The second image sensor 222 is configured to sense the sample grayscales displayed on a second area A2 of the display area DA. The third image sensor 223 is configured to sense the sample grayscales displayed on a third area A3 of the display area DA. The fourth image sensor 224 is configured to sense the sample grayscales displayed on a fourth area A4 of the display area DA.

In an exemplary embodiment, as shown in FIG. 1, each of the first, second, third and third image sensors 221, 222, 223 and 224 senses the sample grayscales displayed on an intensity area in a corresponding area, respectively. In one exemplary embodiment, for example, the first image sensor 221 senses the sample grayscales displayed on a first left intensity area L1 and a first left reference intensity area CL1, respectively. In such an embodiment, the second image sensor 222 senses the sample grayscales displayed on a first right intensity area R1 and a first right reference intensity area CR1, respectively. In such an embodiment, the third image sensor 223 senses the sample grayscales displayed on a second left intensity area L2, which is spaced apart from the first left intensity area L1 in a vertical direction (upper/lower direction), and a second left reference intensity area CL2, which is spaced apart from the first left reference intensity area CL1 in the vertical direction. In such an embodiment, the third image sensor 224 senses the sample grayscales displayed on a second right intensity area R2, which is spaced apart from the first right intensity area R1 in the vertical direction, and a second right reference intensity area CR2, which is spaced apart from the first right reference intensity area CR1 in the vertical direction.

The average intensity calculator 230 calculates an average intensity value of pixels in each of the first left intensity area L1, the first left reference intensity area CL1, the first right intensity area R1, the first right reference intensity area CR1, the second left intensity area L2, the second left reference intensity area CL2, the second right intensity area R2 and the second right reference intensity area CR2 utilizing sensed data received from the first, second, third and third image sensors 221, 222, 223 and 224.

In one exemplary embodiment, for example, each of the first and second left intensity areas L1 and L2 may have a size corresponding to about 30×30 pixels. In such an embodiment, the first left intensity area L1 is spaced apart by about 30 pixels from each of a left end portion of the display area DA and a first boundary b1 of the first and third areas A1 and A3. In such an embodiment, the second left intensity area L2 is spaced apart by about 30 pixels from each of the left end portion and the first boundary b1 of the second and fourth areas A2 and A4. In such an embodiment, each of the first and second right intensity areas R1 and R2 may have a size corresponding to about 30×30 pixels. In such an embodiment, the first right intensity area R1 is spaced apart by about 30 pixels from each of a right end portion of the display area DA and the first boundary b1. In such an embodiment, the second right intensity area R2 is spaced apart by about 30 pixels from each of the right end portion of the display area DA and the first boundary b1.

Each of the first left reference intensity area CL1, the first right reference intensity area CR1, the second left reference intensity area CL2 and the second right reference intensity area CR2 is spaced apart by about 30 pixels from each of the first boundary b1 and a second boundary b2, and may have a size corresponding to the about 30×30 pixels. The second boundary b2 is a boundary of the first and second areas A1 and A2, and a boundary of the third and fourth areas A3 and A4.

In an exemplary embodiment, the left-right intensity estimator 240 calculates intensity estimation values of left boundary area BL, left reference boundary area BCL, right boundary area BR and right reference boundary area BCR that overlaps the first boundary b1 utilizing the average intensity value calculated from the average intensity calculator 230.

Each of the first and second left intensity areas L1 and L2 is spaced apart from the left boundary area BL in the vertical direction, and the first and second left intensity areas L1 and L2 are opposite to each other with respect to the first boundary b1. Each of the first and second left reference intensity areas CL1 and CL2 are spaced apart from the left reference boundary area BCL in the vertical direction, and the first and second left reference intensity areas CL1 and CL2 are opposite to each other with respect to the first boundary b1. Each of the first and second right intensity areas R1 and R2 are spaced apart from the right boundary area BR in the vertical direction, and the first and second right intensity areas R1 and R2 are opposite to each other with respect to the first boundary b1. Each of the first and second right reference intensity areas CR1 and CR2 are spaced apart from the right reference boundary area BCR in the vertical direction, and the first and second right reference intensity areas CR1 and CR2 are opposite to each other with respect to the first boundary b1.

In an exemplary embodiment, the gamma curve calculator 250 calculates a left gamma curve utilizing a plurality of intensity estimation values of the left boundary area BL corresponding to the plurality of sample grayscales calculated from the left-right intensity estimator 240. In addition, the gamma curve calculator 250 calculates a left gamma curve utilizing a plurality of intensity estimation values of the right boundary area BR corresponding to the plurality of sample grayscales calculated from the left-right intensity estimator 240.

In such an embodiment, the correction value calculator 260 calculates a first grayscale correction value of the left boundary area BL utilizing the left gamma curve in order that the intensity estimation value of the left boundary area BL is substantially equal to the intensity estimation value of the left reference boundary area BCL. The correction value calculator 260 calculates a second grayscale correction value of the right boundary area BR utilizing the left gamma curve in order that the intensity estimation value of the right boundary area BR is substantially equal to the intensity estimation value of the right reference boundary area BCR.

In such an embodiment, the correction value calculator 260 calculates a plurality of left grayscale correction values which is gradually increased from the left reference boundary area BCL to the left boundary area BL based on the first grayscale correction value. The correction value calculator 260 calculates a plurality of right grayscale correction values which is gradually increased from the right reference boundary area BCR to the right boundary area BR based on the second grayscale correction value.

The memory 270 stores the plurality of left grayscale correction values and the plurality of right grayscale correction values corresponding to the plurality of sample grayscales from the correction value calculator 260.

In an exemplary embodiment, the memory 270 is disposed, e.g., mounted, on a circuit board of the display apparatus. The display apparatus corrects grayscale data utilizing the left and right grayscale correction values in the memory 270 and displays an image utilizing the corrected grayscale data.

Therefore, in an exemplary embodiment, a left-right gamma difference of the display apparatus may be effectively compensated such that a left-right intensity of the display apparatus may be substantially uniform. In such an embodiment, the left-right intensity may be gradually compensated from the central area toward a left side and a right side such that the display quality may be improved.

Figure 2A:
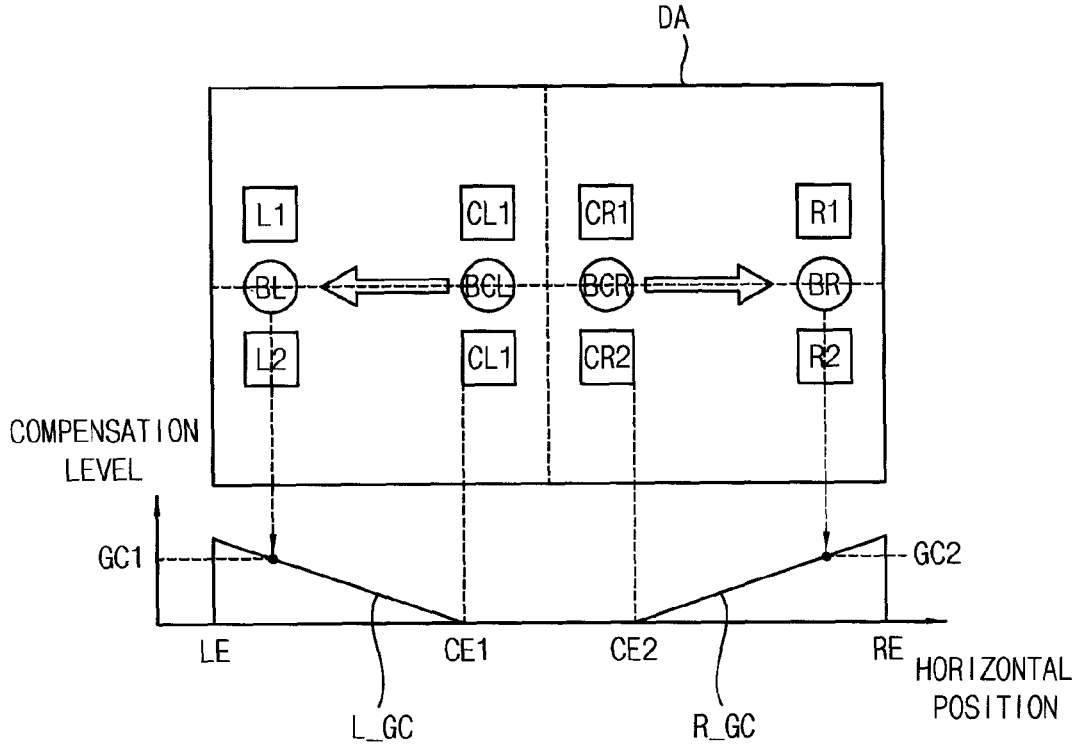
FIGS. 2A to 2C are conceptual diagrams illustrating an exemplary embodiment of a method of compensating a left-right gamma difference by the vision inspection apparatus as shown in FIG. 1.
Figure 2B:
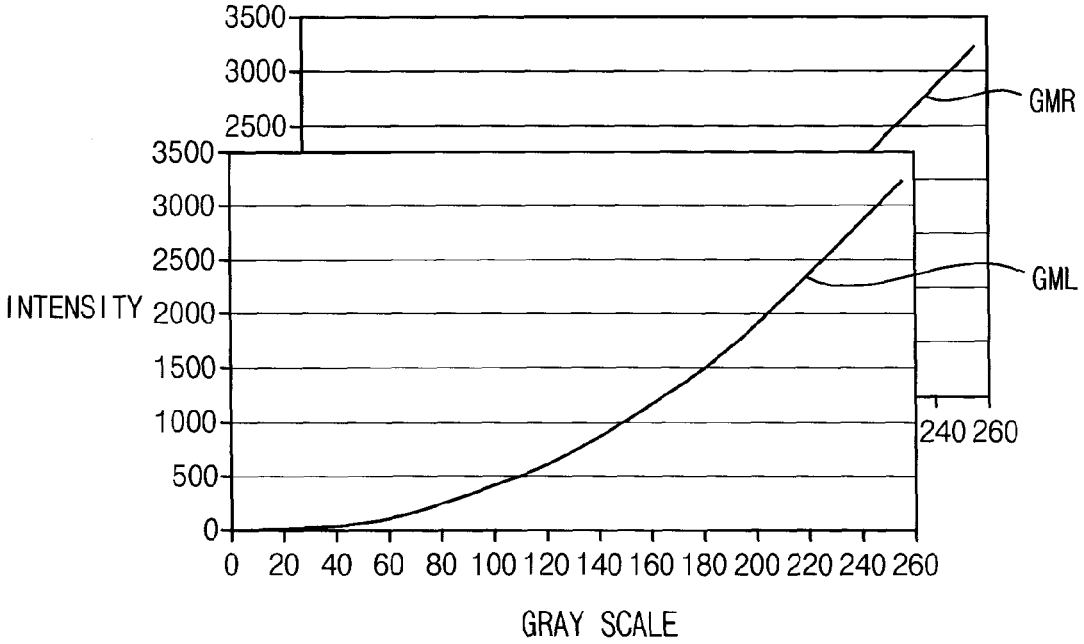
Figure 2C:
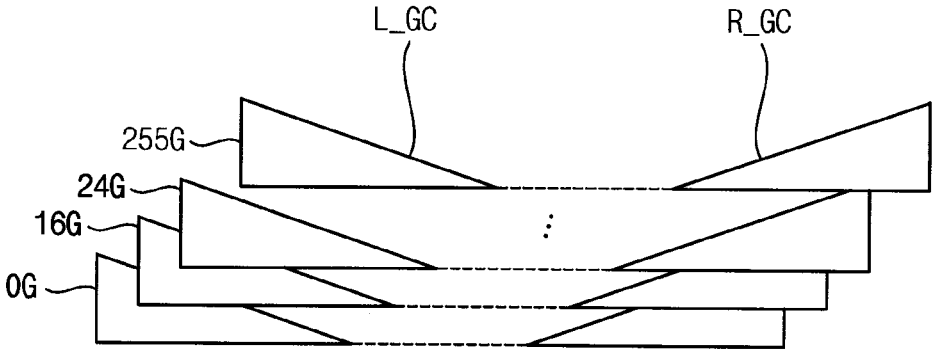
Figure 3:
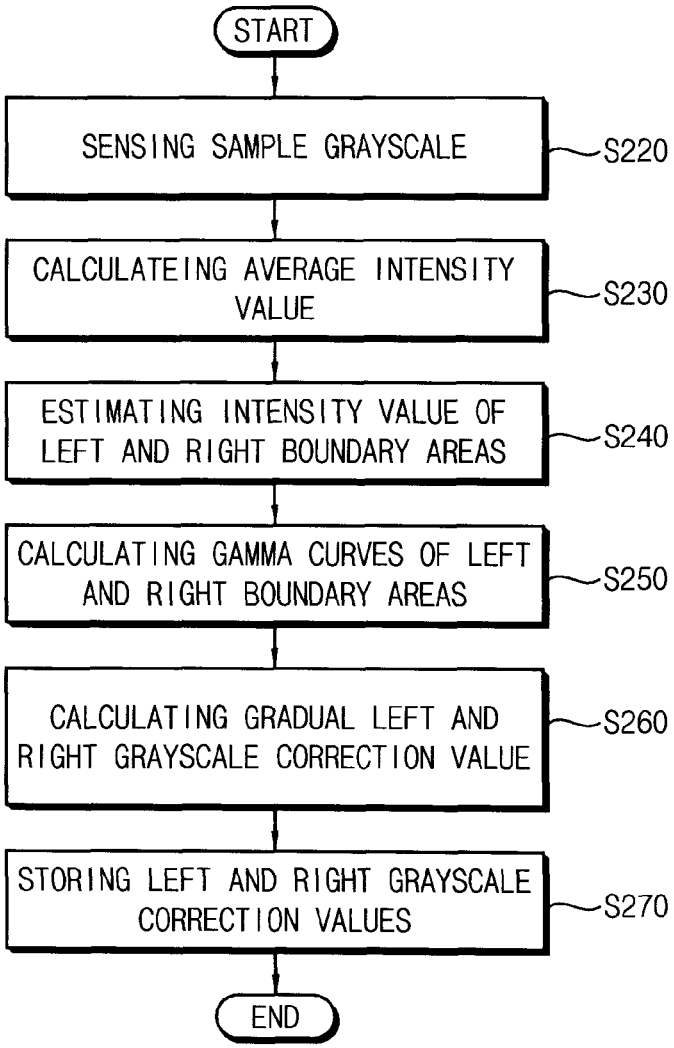
FIG. 3 is a flowchart illustrating an exemplary embodiment of a method of compensating the left-right gamma difference, according to the invention.

FIGS. 2A to 2C are conceptual diagrams illustrating an exemplary embodiment of a method of compensating a left-right gamma difference by the vision inspection apparatus as shown in FIG. 1. FIG. 3 is a flowchart illustrating an exemplary embodiment of a method of compensating the left-right gamma difference, according to the invention.

Referring to FIGS. 1, 2A, 2B, 2C and 3, in an exemplary embodiment, the grayscale displayer 220 displays the plurality of sample grayscales on the display area DA.

The first image sensor 221 senses the sample grayscales displayed on the first left intensity area L1 and the first left reference intensity area CL1 of the display area DA. The second image sensor 222 senses the sample grayscales displayed on the first right intensity area R1 and the first right reference intensity area CR1 of the display area DA. The third image sensor 223 senses the sample grayscales displayed on the second left intensity area L2 and the second left reference intensity area CL2 of the display area DA. The fourth image sensor 224 senses the sample grayscales displayed on the second right intensity area R2 and the second right reference intensity area CR2 of the display area DA (S220).

The average intensity calculator 230 calculates an average intensity value of the pixels in the first left intensity area L1 based on sensed data of the first left intensity area L1, and calculates an average intensity value of the pixels in the first left reference intensity area CL1 based on sensed data of the first left reference intensity area CL1.

The average intensity calculator 230 calculates an average intensity value of the pixels in the first right intensity area R1 based on sensed data of the first right intensity area R1, and calculates an average intensity value of the pixels in the first right reference intensity area CR1 based on sensed data of the first right reference intensity area CR1.

The average intensity calculator 230 calculates an average intensity value of the pixels in the second left intensity area L2 based on sensed data of the second left intensity area L2, and calculates an average intensity value of the pixels in the second left reference intensity area CL2 based on sensed data of the second left reference intensity area CL2.

The average intensity calculator 230 calculates an average intensity value of the pixels in the second right intensity area R2 based on sensed data of the second right intensity area R2, and calculates an average intensity value of the pixels in the second right reference intensity area CR2 based on sensed data of the second right reference intensity area CR2 (S230).

The left-right intensity estimator 240 calculates intensity estimation values of a left boundary area BL, a left reference boundary area BCL, a right boundary area BR and a right reference boundary area BCR, which overlap the first boundary area b1 of the display area DA, utilizing the average intensity values calculated from the average intensity calculator 230 (S240).

In one exemplary embodiment, for example, the intensity estimation value of the left boundary area BL may be estimated by the average intensity values of the first and second left intensity areas L1 and L2. The intensity estimation value of the left reference boundary area BCL may be estimated by the average intensity values of the first and second left reference intensity areas CL1 and CL2. The intensity estimation value of the right boundary area BR may be estimated by the average intensity values of the first and second right intensity areas R1 and R2. The intensity estimation value of the right reference boundary area BCR may be estimated by the average intensity values of the first and second right reference intensity areas CR1 and CR2.

As shown in FIG. 2B, in an exemplary embodiment, the gamma curve calculator 250 calculates a left gamma curve GML utilizing a plurality of intensity estimation values of the left boundary areas BL corresponding to the plurality of sample grayscales calculated from the left-right intensity estimator 240. In such an embodiment, the gamma curve calculator 250 calculates a right gamma curve GMR utilizing a plurality of intensity estimation values of the right boundary areas BR corresponding to the plurality of sample grayscales calculated from the left-right intensity estimator 240 (S250).

As shown in FIG. 2A, in an exemplary embodiment, the correction value calculator 260 calculates a first grayscale correction value GC1 of the left boundary area BL utilizing the left gamma curve GML in order that the intensity estimation value of the left boundary area BL is substantially equal to the intensity estimation value of the left reference boundary area BCL. The correction value calculator 260 calculates a second grayscale correction value GC2 of the right boundary area BR utilizing the right gamma curve GMR in order that the intensity estimation value of the right boundary area BR is substantially equal to the intensity estimation value of the right reference boundary area BCR (S260).

In such an embodiment, the correction value calculator 260 calculates a plurality of left grayscale correction values L_GC, which is gradually increased from an end portion CE1 of the left reference boundary area BCL to a left end portion LE of the display area DA, based on the first grayscale correction value GC1. Then, the correction value calculator 260 calculates a plurality of right grayscale correction values R_GC, which is gradually increased from an end portion CE2 of the right reference boundary area BCR to a right end portion RE of the display area DA, based on the second grayscale correction value GC2.

As shown in FIG. 2C, the memory 270 stores the plurality of left grayscale correction values and the plurality of right grayscale correction values corresponding to the plurality of sample grayscales 0G, 16G, 24G, . . . , 255G, respectively (S270).

Figure 4:
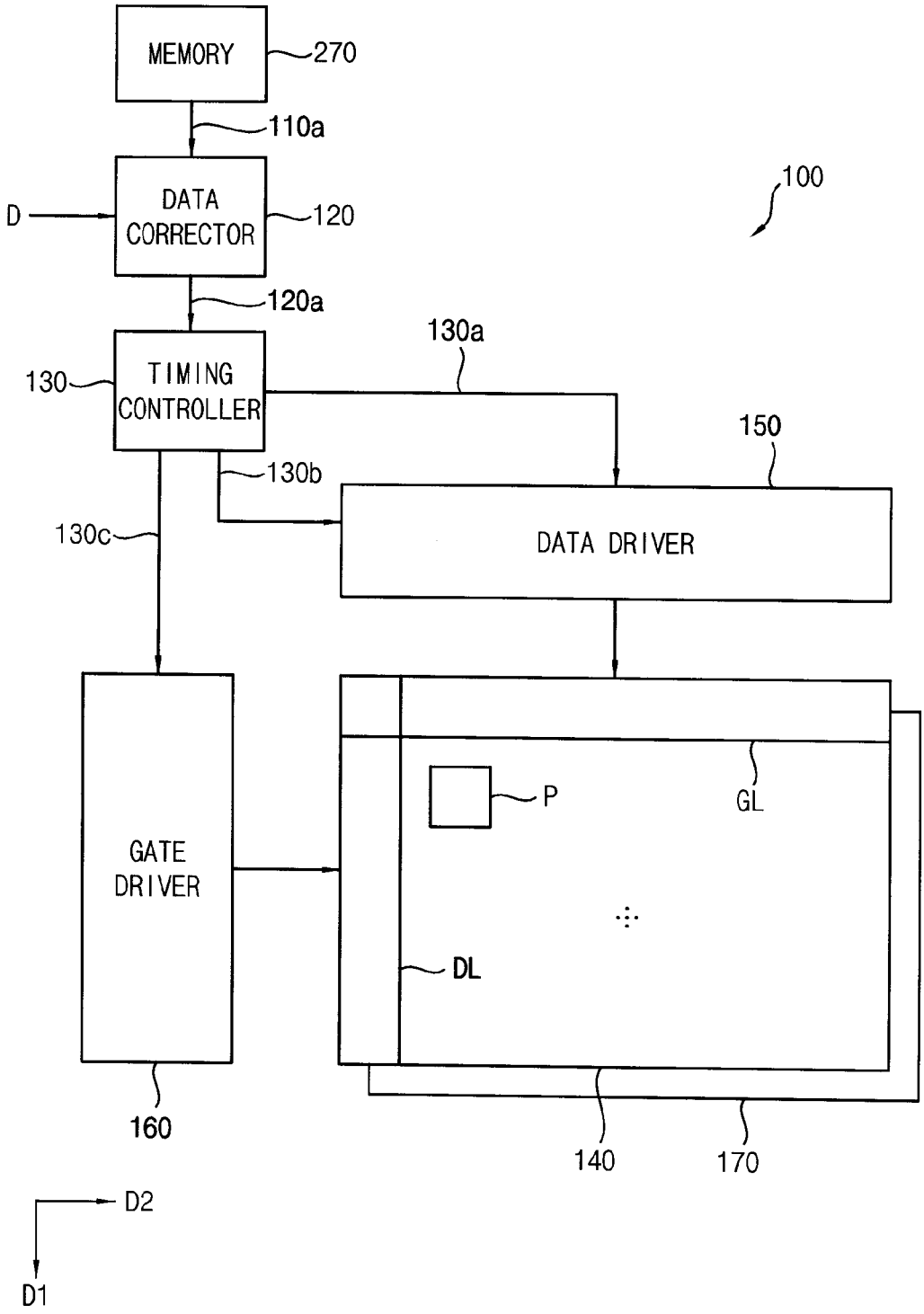
FIG. 4 is a block diagram illustrating an exemplary embodiment of a display apparatus, according to the invention.

FIG. 4 is a block diagram illustrating an exemplary embodiment of a display apparatus, according to the invention.

Referring to FIG. 4, an exemplary embodiment of the display apparatus 100 may include a memory 270, a data corrector 120, a timing controller 130, a display panel 140, a data driver 150, a gate driver 160 and a light-source 170.

The memory 270 stores the plurality of left grayscale correction values corresponding to the plurality of sample grayscales 0G, 16G, 24G, . . . , 255G, respectively, and the plurality of right grayscale correction values corresponding to the plurality of sample grayscales 0G, 16G, 24G, . . . , 255G, respectively, calculated from the vision inspection apparatus as described referring to FIGS. 1 to 3.

The data corrector 120 corrects grayscale data D utilizing the grayscale correction value 110*a* stored in the memory 270 and generates a correction grayscale data 120*a*. An exemplary embodiment of a method of correcting the grayscale data by the data corrector 120 will be described later in detail.

In an exemplary embodiment, the timing controller 130 drives the data driver 150 utilizing the correction grayscale data 120*a* received from the data corrector 120. The timing controller 130 may correct the correction grayscale data through various compensation algorithms, which compensate a response time or a full-white, for example, and may provide the data driver 150 with the correction grayscale data 130*a*.

In such an embodiment, the timing controller 130 generates a data control signal 130*b* which controls a driving timing of the data driver 150 and a gate control signal 130*c* which controls a driving timing of the gate driver 160. The timing controller 130 controls the data driver 150 based on the data control signal 130*b* and controls the gate driver 160 based on the data control signal 130*b*.

The display panel 140 includes a plurality of data lines DL, a plurality of gate lines GL and a plurality of pixels P which is arranged substantially in a matrix form. Each of the pixels P may include a plurality of sub pixels. The data lines DL extend substantially in a first direction D1, are electrically connected to output terminals of the data driver 150, and transfer grayscale voltages outputted from the data driver 150 to the pixels P. The gate lines GL extend substantially in a second direction D2 crossing the first direction D1, are electrically connected to output terminals of the gate driver 160 and transfer gate signals sequentially outputted from the gate driver 160 to the pixels P. Each of the pixels P includes a plurality of sub color pixels. In one exemplary embodiment, for example, the display panel 140 may have a left-right gamma difference with respect to a central area by physical properties of the display panel 140.

The data driver 150 converts the correction grayscale data to a grayscale voltage utilizing a gamma voltage based on a control of the timing controller 130 and provides the data lines DL of the display panel 140 with the grayscale voltage.

The gate driver 160 generates a gate signal based on a control of the timing controller 130 and provides the gate lines GL of the display panel 140 with the gate signal.

The light-source 170 includes at least one light source element which emits light and provides the display panel 140 with the light.

Figure 5:
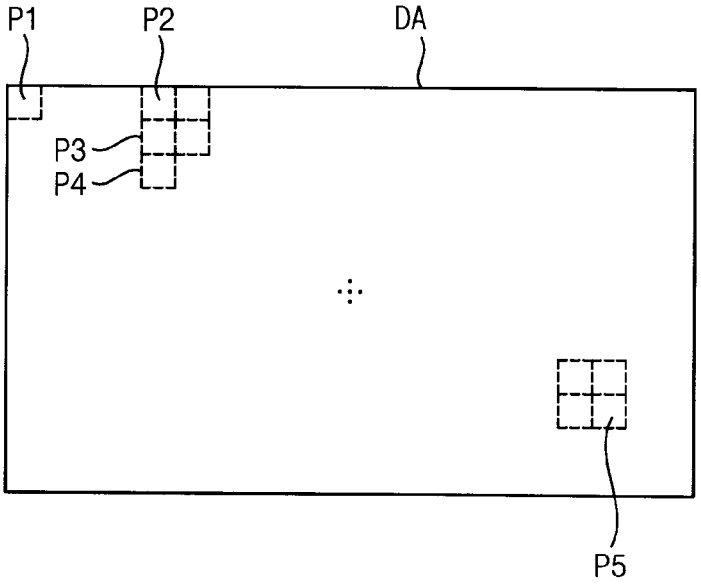
FIG. 5 is a conceptual diagram illustrating an exemplary embodiment of a method of correcting grayscale data by the display apparatus as shown in FIG. 4.

FIG. 5 is a conceptual diagram illustrating an exemplary embodiment of a method of correcting grayscale data by the display apparatus as shown in FIG. 4.

Referring to FIGS. 4 and 5, an exemplary embodiment of the display panel 140 includes a display area DA in which a plurality of pixels P is disposed. The pixels P may be arranged substantially in a matrix form which includes a plurality of pixel columns and a plurality of pixel rows. The memory 270 stores the plurality of left grayscale correction values corresponding to the plurality of sample grayscales, respectively, and the plurality of right grayscale correction values corresponding to the plurality of sample grayscales, respectively. The plurality of sample grayscales may include 0-grayscale, 16-grayscale, 24-grayscale, 32-grayscale, 64-grayscale, 96-grayscale, 128-grayscale, 192-grayscale and 255-grayscale with respect to 256 of total grayscale number.

In one exemplary embodiment, for example, as shown in FIG. 5, a first pixel P1 may be in a first pixel column. Second, third and fourth pixels P2, P3 and P4 may be in an N-th pixel column. Fifth pixel P5 may be in an M-th pixel column. Here, N and M are a natural number.

When the grayscale data of the first pixel P1 is 16-grayscale that is a sample grayscale, the data corrector 120 generates the correction grayscale data of the first pixel P1 utilizing the grayscale correction value corresponding to the first pixel column among the grayscale correction values of the 16-grayscale stored in the memory 270.

When the grayscale data of the second pixel P2 is 20-grayscale that is not a sample grayscale, the data corrector 120 calculates the grayscale correction value of the 20-grayscale through an interpolation utilizing the grayscale correction value corresponding to the N-th pixel column among the grayscale correction values of the 16-grayscale that is a sample grayscale approximate to the 20-grayscale and the grayscale correction value corresponding to the N-th pixel column among the grayscale correction values of the 24-grayscale that is a sample grayscale approximate to the 20-grayscale. Thus, the data corrector 120 generates the correction grayscale data of the second pixel P2 corresponding to the 20-grayscale.

When the grayscale data of the third pixel P3 is 24-grayscale that is a sample grayscale, the data corrector 120 generates the correction grayscale data of the third pixel P3 utilizing the grayscale correction value corresponding to the N-th pixel column among the grayscale correction values of the 24-grayscale stored in the memory 270.

When the grayscale data of the fourth pixel P4 is 24-grayscale that is a sample grayscale, the data corrector 120 generates the correction grayscale data of the fourth pixel P4 utilizing the grayscale correction value corresponding to the N-th pixel column among the grayscale correction values of the 24-grayscale stored in the memory 270. The fourth pixel P4 is included in the same pixel column as the third pixel P3 and has the same grayscale data as the third pixel P3 so that the grayscale correction value of the fourth pixel P4 may be substantially the same as the third pixel P3.

When the grayscale data of the fifth pixel P5 is 120-grayscale that is not a sample grayscale, the data corrector 120 calculates the grayscale correction value of the fifth pixel P5 through the interpolation utilizing the grayscale correction value corresponding to the M-th pixel column among the grayscale correction values of the 96-grayscale that is a sample grayscale approximate to the 120-grayscale and the grayscale correction value corresponding to the M-th pixel column among the grayscale correction values of the 128-grayscale that is a sample grayscale approximate to the 120-grayscale. Thus, the data corrector 120 generates the correction grayscale data of the fifth pixel P5 corresponding to the 120-grayscale.

As described above, in an exemplary embodiment, the data corrector 120 corrects the grayscale data of the display apparatus 100 utilizing the left-right grayscale correction values corresponding to the sample grayscales stored in the memory 270.

The data driver 150 drives the pixels of the display panel 140 based on the correction grayscale data provided from the data corrector 120. Therefore, a left-right intensity of an image displayed on the display panel 140 may be substantially uniform.

According to exemplary embodiments of the invention, as described herein, a left-right gamma difference of the display apparatus may be effectively compensated such that a left-right intensity of the display apparatus may be substantially uniform. In such embodiments, the left-right intensity may be gradually compensated from the central area toward a left side and a right side such that the display quality may be improved.

The foregoing is illustrative of the invention and is not to be construed as limiting thereof. Although a few exemplary embodiments of the invention have been described, those skilled in the art will readily appreciate that many modifications are possible in the exemplary embodiments without materially departing from the novel teachings and advantages of the invention. Accordingly, all such modifications are intended to be included within the scope of the invention as defined in the claims. Therefore, it is to be understood that the foregoing is illustrative of the invention and is not to be construed as limited to the specific exemplary embodiments disclosed, and that modifications to the disclosed exemplary embodiments, as well as other exemplary embodiments, are intended to be included within the scope of the appended claims. The invention is defined by the following claims, with equivalents of the claims to be included therein.

What is claimed is:

1. A method of compensating a left-right gamma difference in a display apparatus using a vision inspection apparatus, the method comprising:

sensing a plurality of sample grayscales displayed on a plurality of areas defined on a display area of the display apparatus using a plurality of image sensors of the vision inspection apparatus;

estimating intensity values of a left reference boundary area, which is adjacent to a left side at a central area of the display area, a left boundary area, which is adjacent to a left end portion of the display area, a right reference boundary area, which is adjacent to a right side at the central area, and a right boundary area, which is adjacent to a right end portion of the display area;

calculating a first grayscale correction value of the left boundary area such that an intensity estimation value of the left boundary area is substantially equal to an intensity estimation value of the left reference boundary area; and calculating a second grayscale correction value of the right boundary area such that an intensity estimation value of the right boundary area is substantially equal to an intensity estimation value of the right reference boundary area, wherein a left-right intensity of an image displayed in the display area is substantially uniform across the entire display area in at least one pixel row using the first gray scale correction value and the second grayscale correction value.

2. The method of claim 1, wherein a plurality of left grayscale correction values, which is gradually increased from the central area to the left end portion of the display area, is calculated based on the first grayscale correction value of the left boundary area, and a plurality of right grayscale correction values, which is gradually increased from the central area to the right end portion of the display area, is calculated based on the second grayscale correction value of the right boundary area.

3. The method of claim 2, further comprising:

storing the plurality of left grayscale correction values corresponding to the plurality of sample grayscales, respectively, and the plurality of right grayscale correction values corresponding to the plurality of sample grayscales, respectively.

4. The method of claim 1, further comprising:

calculating a plurality of average intensity values of first and second left intensity areas, which are located opposite to each other in a vertical direction from the left boundary area, a plurality of average intensity values of first and second left reference intensity areas, which are located opposite to each other in the vertical direction from the left reference boundary area, a plurality of average intensity values of first and second right intensity areas which are located opposite to each other in the vertical direction from the right boundary area, a plurality of average intensity values of first and second right reference intensity areas, which are located opposite to each other in the vertical direction from the right reference boundary area, utilizing sensed data received from the plurality of image sensors.

5. The method of claim 4, wherein the intensity estimation value of the left reference boundary area is calculated utilizing the average intensity values of the first and second left reference intensity areas, the intensity estimation value of the left boundary area is calculated utilizing the average intensity values of the first and second left intensity areas, the intensity estimation value of the right reference boundary area is calculated utilizing the average intensity values of the first and second right reference intensity areas, and the intensity estimation value of the right boundary area is calculated utilizing the average intensity values of the first and second right intensity areas.

6. The method of claim 5, wherein the sensed data of the first left intensity area and the first left reference intensity area are sensed by a first image sensor of the plurality of image sensors, the sensed data of the first right intensity area and the first right reference intensity area are sensed by a second image sensor of the plurality of image sensors, the sensed data of the second left intensity area and the second left reference intensity area are sensed by a third image sensor of the plurality of image sensors, and the sensed data of the second right intensity area and the second right reference intensity area are sensed by a fourth image sensor of the plurality of image sensors.

7. The method of claim 6, wherein each of the first left intensity area, the first left reference intensity area, the first right intensity area, the first right reference intensity area, the second left intensity area, the second left reference intensity area, the second right intensity area and the second right reference intensity area is defined by a plurality of pixels of the display apparatus.

8. The method of claim 1, further comprising:

calculating a left gamma curve utilizing a plurality of intensity estimation values of the left boundary area corresponding to the plurality of sample grayscales, respectively, and calculating a right gamma curve utilizing a plurality of intensity estimation values of the right boundary area corresponding to the plurality of sample grayscales, respectively.

9. The method of claim 8, wherein the first grayscale correction value of the left boundary area is calculated utilizing the left gamma curve, and the second grayscale correction value of the right boundary area is calculated utilizing the right gamma curve.

10. A vision inspection apparatus comprising:

a plurality of image sensors configured to sense a plurality of sample grayscales displayed on a plurality of areas defined in a display area of a display apparatus;

a left-right intensity estimator configured to calculate intensity estimation values of a left reference boundary area which is adjacent to a left side at a central area of the display area, a left boundary area which is adjacent to a left end portion of the display area, a right reference boundary area which is adjacent to a right side at the central area, and a right boundary area which is adjacent to a right end portion of the display area; and a correction value calculator configured to calculate a first grayscale correction value of the left boundary area such that an intensity estimation value of the left boundary area is equal to an intensity estimation value of the left reference boundary area, and a second grayscale correction value of the right boundary area such that an intensity estimation value of the right boundary area is equal to an intensity estimation value of the right reference boundary area, wherein a left-right intensity of an image displayed in the display area is substantially uniform across the entire display area in at least one pixel row using the first gray scale correction value and the second grayscale correction value.

11. The vision inspection apparatus of claim 10, wherein the correction value calculator is configured to calculate a plurality of left grayscale correction values, which is gradually increased from the central area to the left end portion of the display area, based on the first grayscale correction value of the left boundary area, and the correction value calculator is configured to calculate a plurality of right grayscale correction values, which is gradually increased from the central area to the right end portion of the display area, based on the second grayscale correction value of the right boundary area.

12. The vision inspection apparatus of claim 11, further comprising;

a memory configured to store the plurality of left grayscale correction values corresponding to the plurality of sample grayscales, respectively, and the plurality of right grayscale correction values corresponding to the plurality of sample grayscales, respectively.

13. The vision inspection apparatus of claim 10, further comprising;

an average intensity calculator configured to calculate a plurality of average intensity values of first and second left intensity areas which are located opposite to each other in a vertical direction from the left boundary area, a plurality of average intensity values of first and second left reference intensity areas which are located opposite to each other in the vertical direction from the left reference boundary area, a plurality of average intensity values of first and second right intensity areas which are located opposite to each other in the vertical direction from the right boundary area, and a plurality of average intensity values of first and second right reference intensity areas which are located opposite to each other in the vertical direction from the right reference boundary area, utilizing sensed data received from the plurality of image sensors.

14. The vision inspection apparatus of claim 13, wherein the average intensity calculator is configured to calculate the intensity estimation value of the left reference boundary area utilizing the average intensity values of the first and second left reference intensity areas, the average intensity calculator is configured to calculate the intensity estimation value of the left boundary area utilizing the average intensity values of the first and second left intensity areas, the average intensity calculator is configured to calculate the intensity estimation value of the right reference boundary area utilizing the average intensity values of the first and second right reference intensity areas, and the average intensity calculator is configured to calculate the intensity estimation value of the right boundary area utilizing the average intensity values of the first and second right intensity areas.

15. The vision inspection apparatus of claim 13, wherein the plurality of image sensors comprises:

a first image sensor configured to sense the plurality of sample grayscales displayed on the first left intensity area and the first left reference intensity area;

a second image sensor configured to sense the plurality of sample grayscales displayed on the first right intensity area and the first right reference intensity area;

a third image sensor configured to sense the plurality of sample grayscales displayed on the second left intensity area and the second left reference intensity area are sensed by; and a fourth image sensor configured to sense the plurality of sample grayscales on displayed on the second right intensity area and the second right reference intensity.

16. The vision inspection apparatus of claim 15, wherein each of the first left intensity area, the first left reference intensity area, the first right intensity area, the first right reference intensity area, the second left intensity area, the second left reference intensity area, the second right intensity area and the second right reference intensity area is defined by a plurality of pixels of the display apparatus, and the average intensity calculator is configured to calculate an average intensity value of the plurality of pixels.

17. The vision inspection apparatus of claim 10, further comprising:

a gamma curve calculator configured to calculate a left gamma curve utilizing a plurality of intensity estimation values of the left boundary area corresponding to the plurality of sample grayscales, respectively, and to calculate a right gamma curve utilizing a plurality of intensity estimation values of the right boundary area corresponding to the plurality of sample grayscales, respectively.

18. The vision inspection apparatus of claim 17, wherein the correction value calculator is configured to calculate the first grayscale correction value of the left boundary area utilizing the left gamma curve, and to calculate the second grayscale correction value of the right boundary area utilizing the right gamma curve.

19. A display apparatus comprising:

a display panel comprising a plurality of pixels disposed in a display area;

a memory which stores a first grayscale correction value of a left boundary area and a second grayscale correction value of a right boundary area to compensate a gamma difference between the left boundary area and the right boundary area, wherein the left boundary area is located adjacent to a left end portion of the display area, and the right boundary area is located adjacent to a right end portion of the display area;

a data corrector configured to generate correction grayscale data to correct grayscale data of a pixel based on the first and second grayscale correction values; and a data driver configured to generate a grayscale voltage based on the correction grayscale data and to provide a data line of the display panel with the grayscale voltage, wherein a left-right intensity of an image displayed in the display area is substantially uniform across the entire display area in at least one pixel row using the first and second grayscale correction values.

20. The display apparatus of claim 19, wherein the memory is configured to store a plurality of left grayscale correction values corresponding to a plurality of sample grayscales, respectively, and a plurality of right grayscale correction values corresponding to the plurality of sample grayscales, respectively, wherein the plurality of left grayscale correction values is gradually increased from the central area to the left end portion of the display area based on the first grayscale correction value of the left boundary area, and the plurality of right grayscale correction values is gradually increased from the central area to the right end portion of the display area based on the second grayscale correction value of the right boundary area.

* * * * *